US008500362B2

(12) United States Patent
Steffen

(10) Patent No.: US 8,500,362 B2
(45) Date of Patent: Aug. 6, 2013

(54) MOLDED BRICK FOR LAYING GROUND COVERINGS

(75) Inventor: Stephan Steffen, Bremen (DE)

(73) Assignee: SF-Kooperation GmbH Beton-Konzepte, Bremen (DE)

( * ) Notice: Subject to any disclaimer, the term of this patent is extended or adjusted under 35 U.S.C. 154(b) by 0 days.

(21) Appl. No.: 13/120,272

(22) PCT Filed: Sep. 12, 2009

(86) PCT No.: PCT/EP2009/006624

§ 371 (c)(1),
(2), (4) Date: Jun. 3, 2011

(87) PCT Pub. No.: WO2010/034417

PCT Pub. Date: Apr. 1, 2010

(65) Prior Publication Data

US 2011/0243660 A1 Oct. 6, 2011

(30) Foreign Application Priority Data

Sep. 25, 2008 (DE) ..... 10 2008 048 957

(51) Int. Cl.
*E01C 5/06* (2006.01)

(52) U.S. Cl.
USPC ..... 404/36; 404/34; 404/39

(58) Field of Classification Search
CPC ..... E01C 5/06
USPC ..... 404/34–39
See application file for complete search history.

(56) References Cited

U.S. PATENT DOCUMENTS

| | | | | |
|---|---|---|---|---|
| 1,070,870 | A * | 8/1913 | Barbour | 404/38 |
| 2,605,681 | A | 8/1952 | Trief | |
| 4,761,095 | A * | 8/1988 | Bartlechner | 404/41 |
| 4,773,790 | A * | 9/1988 | Hagenah | 404/41 |
| 4,792,257 | A * | 12/1988 | Rinninger | 404/41 |
| 5,051,023 | A * | 9/1991 | Yoshida et al. | 404/39 |
| 5,503,498 | A * | 4/1996 | Scheiwiller | 404/34 |
| 5,533,827 | A * | 7/1996 | Scheiwiller | 404/38 |
| 5,645,369 | A * | 7/1997 | Geiger | 404/34 |
| 6,939,077 | B1 * | 9/2005 | Hart | 404/39 |

(Continued)

FOREIGN PATENT DOCUMENTS

| | | | |
|---|---|---|---|
| DE | 812675 | C | 9/1951 |
| DE | 2512961 | A1 | 10/1976 |

(Continued)

OTHER PUBLICATIONS

German Patent Office search report (Aug. 7, 2009).

(Continued)

*Primary Examiner* — Raymond W Addie
(74) *Attorney, Agent, or Firm* — Laurence P. Colton; Smith Risley Tempel Santos LLC

(57) ABSTRACT

A molded brick, in particular made from concrete, for laying ground coverings (10, 30), the molded brick (11, 12, 31, 32, 33) having an upper side (13) which is delimited in the transition to upright side faces (15, 16, 17, 18) by a side edge (20) which frames the upper side (13). The course of the side edge (20) of the molded brick is of curved configuration at least in regions and to correspond to a mathematical function, the course of the side edge (20) preferably corresponding at least in regions to the function $f(x)=a*\ln(x)+b$.

15 Claims, 10 Drawing Sheets

U.S. PATENT DOCUMENTS

| | | | | |
|---|---|---|---|---|
| 7,425,106 | B2 * | 9/2008 | Altmann et al. | 404/39 |
| 7,819,607 | B2 * | 10/2010 | Carreras-Maldonado et al. | 404/34 |
| 7,850,394 | B2 * | 12/2010 | Schroder | 404/38 |

FOREIGN PATENT DOCUMENTS

| | | | |
|---|---|---|---|
| DE | 8412667 | U1 | 8/1984 |
| DE | 8504196 | U1 | 5/1985 |
| DE | 9214868 | U1 | 1/1993 |
| DE | 4340837 | B4 | 6/1995 |
| DE | 29509796 | U1 | 12/1995 |
| DE | 19716149 | A1 | 10/1997 |
| FR | 2755983 | A1 | 5/1998 |

OTHER PUBLICATIONS

PCT International Search Report (ISR) (Dec. 17, 2009).

* cited by examiner 10
11
12
29

29
30
31
32
33

MOLDED BRICK FOR LAYING GROUND COVERINGS

BACKGROUND OF THE INVENTION

1. Technical Field

The invention relates to a molded brick, in particular made from concrete, for laying ground coverings, the molded brick having an upper side which is delimited in the transition to upright side faces by a side edge which frames the upper side. Furthermore, the invention relates to a ground covering comprising molded bricks of this type.

2. Prior Art

Molded bricks for ground coverings are known from practice in different designs. For example, there are molded bricks with rectilinearly extending side edges, or molded bricks which are reminiscent of natural stones with regard to the design and have irregularly shaped side edges and side faces.

Proceeding from this, the invention is based on the object of developing molded bricks of the type mentioned in the introduction, in particular with regard to a harmonious course of the side edge.

BRIEF SUMMARY OF THE INVENTION

In order to achieve this object, a molded brick which is designed according to the invention is a molded brick, in particular made from concrete, for laying ground coverings, the molded brick having an upper side which is delimited in the transition to upright side faces by a side edge which frames the upper side, characterized in that the course of the side edge is of curved configuration at least in regions and corresponds to a mathematical function. According to this, there is provision for the course of the side edge to be of curved configuration at least in regions and to correspond to a mathematical function.

It has been shown that the use of a mathematical function for fixing the course of the side edge leads overall to an improved appearance of the molded brick in comparison with conventional methods.

There is provision in one preferred development of the invention for the profile of the side edge to correspond at least in regions to the function $f(x)=a*\ln(x)+b$. The use of a function on the basis of the logarithm surprisingly results in a particularly harmonious appearance.

A further special feature can consist in that the course of curved regions of the side edge is different, in particular in the case of the use of the above function by using different values for the variables a and b for different regions. In other words, it is proposed not to select the same function for all regions of the side edge, but on the other hand also not to use completely different functions, but rather only to use parameters for always adapting basically the same function.

According to one preferred development of the invention, the course of the side edge is not stipulated continuously by the mathematical function, but rather the regions of the side edge which are curved according to the mathematical function are connected to circular extending regions. This leads to an appealing exterior of the molded brick.

A preferably independent achievement of the object can consist in the course of the side edge having concavely and convexly curved regions. In this way, special optical effects can be achieved when laying molded bricks of this type to form a ground covering, such as the impression that the molded bricks appear to have an arched upper side, although the upper side is actually substantially flat.

There is preferably provision in this context for the side edge to have a bulge in the region of a longitudinal side of the molded brick, such that two concavely curved regions of the side edge enclose a convexly curved region of the side edge.

It is particularly advantageous if the upright side faces are not of curved configuration, but rather extend substantially in a continuous plane and in an upright manner until shortly before the region of the upper side, the transition between the planar side faces and the curved side edges being compensated for by transition faces, in particular in the region of a circumferential bevel. In this way, the molded bricks can namely be laid particularly easily. In addition, it is simply possible in this way to integrally form spacers on the side faces which are otherwise planar.

Furthermore, protection is claimed for a ground covering comprising the molded bricks according to the invention.

A further special feature consists in the adaptation of the molded bricks for carrying horizontal loads.

Further details result from the subclaims and otherwise from the description.

BRIEF DESCRIPTION OF THE DRAWINGS

In the following text, one preferred exemplary embodiment of the invention will be explained using the drawing, in which.

DETAILED DESCRIPTION OF PREFERRED EMBODIMENTS

Figure 2:
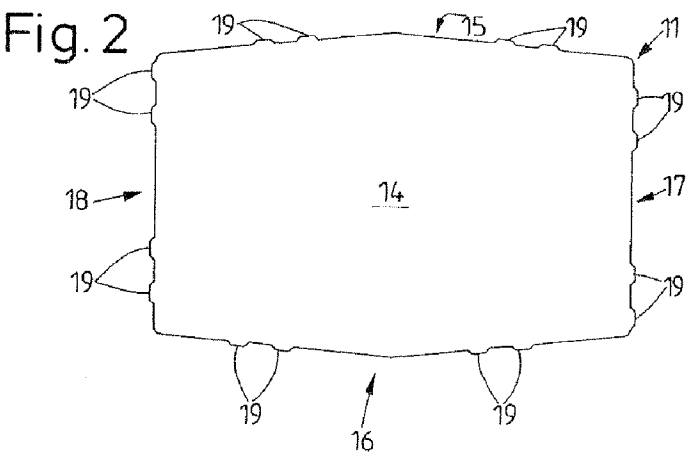
FIG. 2 shows the molded brick according to FIG. 1 in a view from below.
Figure 4:
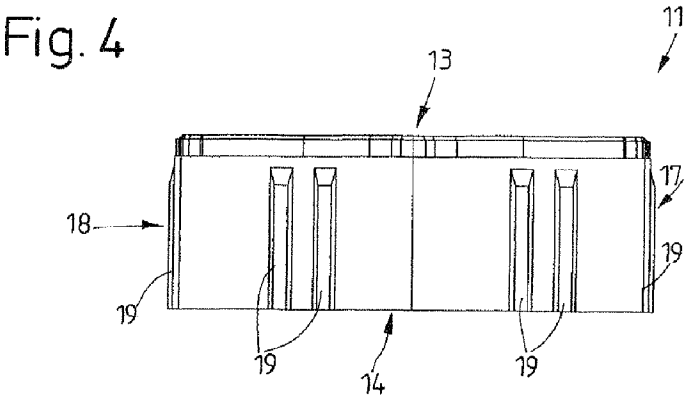
FIG. 4 shows the molded brick according to FIG. 1 in a view of a long side face.
Figure 1:
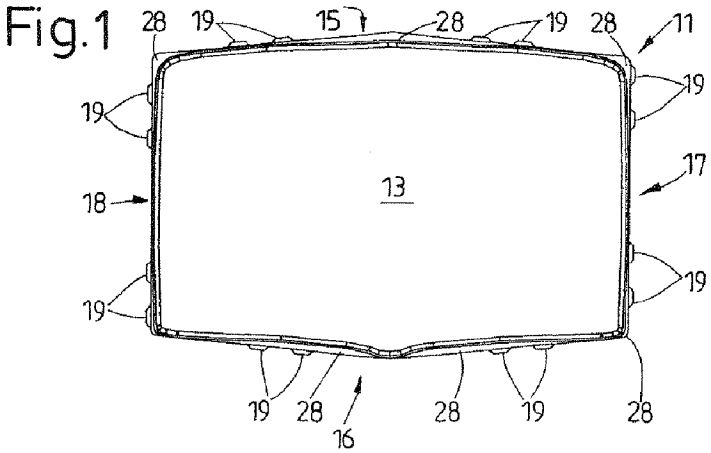
FIG. 1 shows a first molded brick according to the invention in a plan view.
Figure 3:
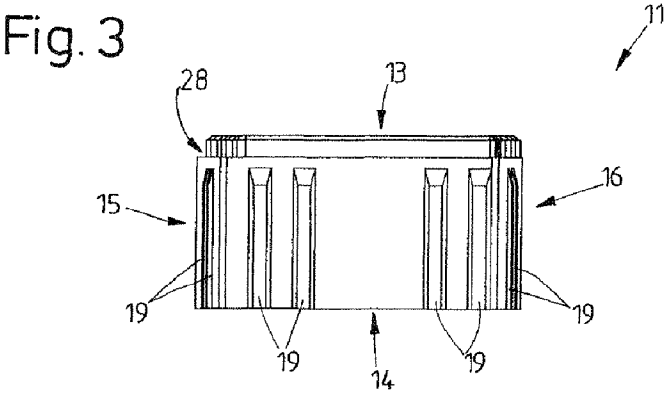
FIG. 3 shows the molded brick according to FIG. 1 in a view of a short side face.
Figure 6:
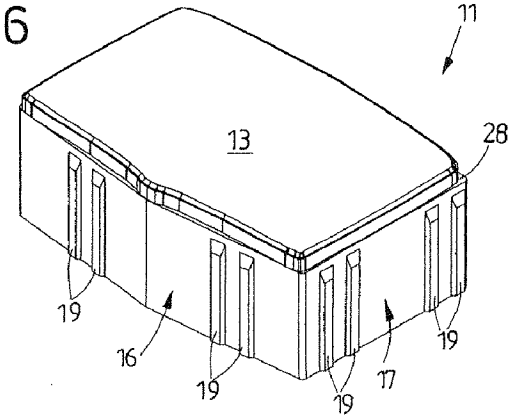
FIG. 5 to FIG. 8 show isometric representations of the molded brick according to FIG. 1.
Figure 5:
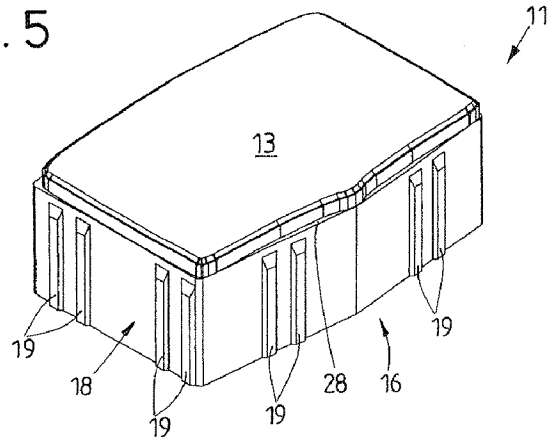
Figure 8:
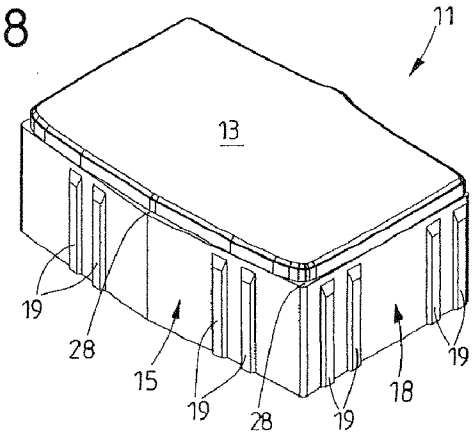
Figure 7:
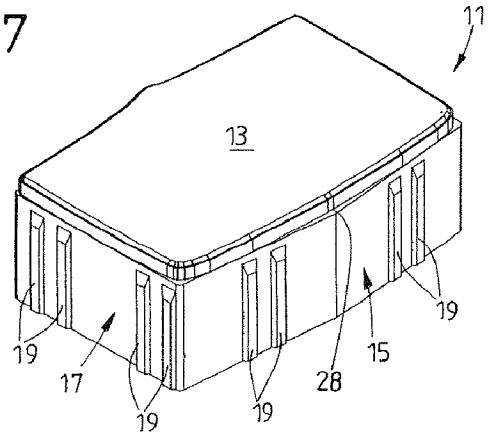

First of all, the exemplary embodiment according to FIGS. 1 to 21 will be described. After this, the exemplary embodiment according to FIGS. 22 to 43 will be described, only the differences from the first exemplary embodiment being concentrated on there. Here, consistent designations are used for identical parts.

The first exemplary embodiment is concerned with the production of a ground covering 10 from two different types of molded bricks 11, 12 which, combined with one another, are laid to form the ground covering 10. A first type of molded brick 11 is shown in figs FIGS. 1 to 9, and the second type of molded brick 12 results from FIGS. 10 to 17.

The molded bricks 11, 12 in each case have a planar upper side 13, a corresponding lower side 14 and four upright side faces, namely longer longitudinal side faces 15, 16 and shorter transverse side faces 17, 18. While the transverse side faces 17, 18 have a continuous rectilinear course, the longitudinal side faces 15, 16 are of angled away or kinked configuration, with the result that the molded bricks 11, 12 have an elongate hexagonal design in outline, the longitudinal side faces 15, 16 being angled away in the region of the longitudinal center.

A further feature is spacers 19 which are arranged on the side faces 15, 16, 17, 18 and, starting from the lower side 14, extend until shortly before the upper side 13 of the molded bricks 11, 12. The spacers are integrally formed on the side faces 15, 16, 17, 18 in pairs as elongate web-like structures with a beveled upper side. Depending on the intended use, the spacers 19 can also be dispensed with, or the spacers 19 can have a different design and/or arrangement.

One special feature of the molded bricks 11, 12 lies in the design of side edges 20 which extend circumferentially in the region of the upper side 13 of the molded bricks 11, 12. In the present case, the side edge 20 of the upper side 13 is understood as being the transition from the upper side 13 to the upright side faces 15, 16, 17, 18. In the present case, the special feature consists in the circumferential side edge 20 being of curved configuration in outline. To this end, reference is made to FIG. 9. The individual sections of the side edge 20 are shown diagrammatically there, with in each case regions of different curvature. Furthermore, it can be seen that the molded brick 11 has an axis of symmetry 21 which extends transversely through the two longitudinal side faces 15, 16, namely in the longitudinal center of the latter.

Figure 9:
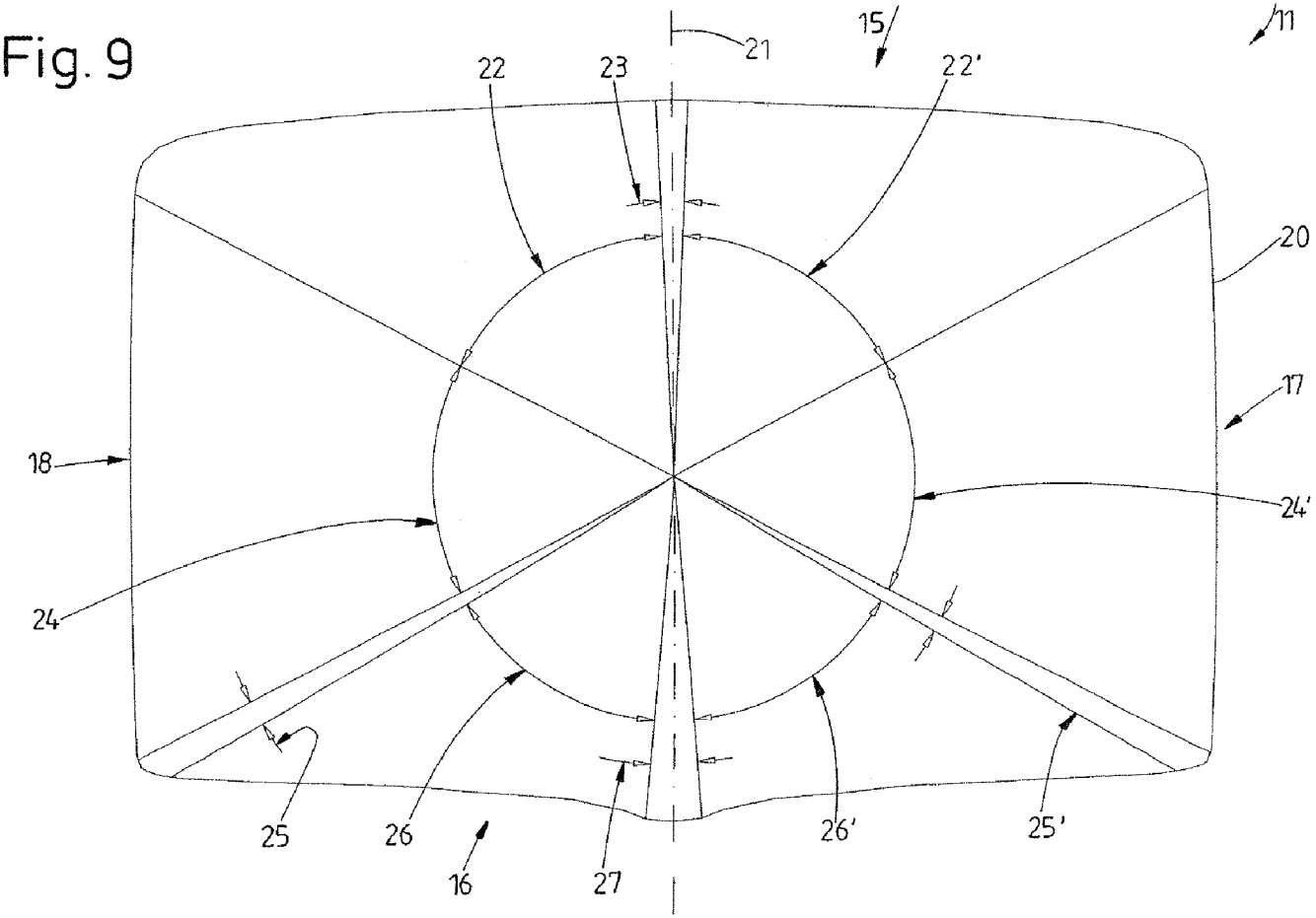
FIG. 9 shows a diagrammatic plan view of the molded brick according to FIG. 1 with a representation of the construction of the side edges.
Figure 11:
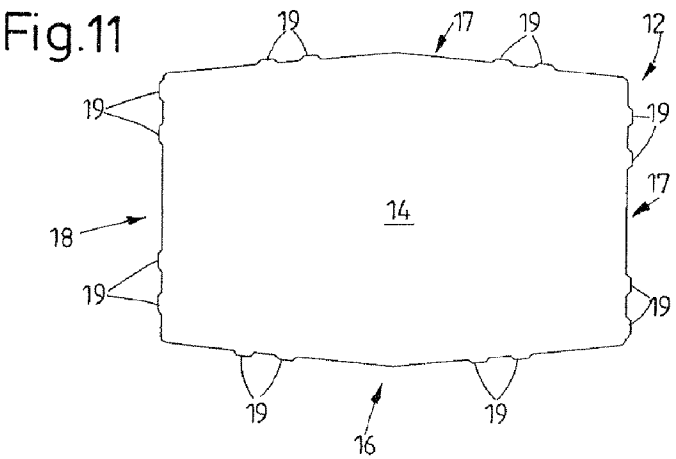
FIG. 10 to FIG. 17 show a second molded brick according to the invention in an analogous representation to FIG. 1 to FIG. 8, FIG. 18 to FIG. 21 show a ground covering comprising molded bricks according to FIGS. 1 to 17 in a plan view and in a three-dimensional representation.
Figure 10:
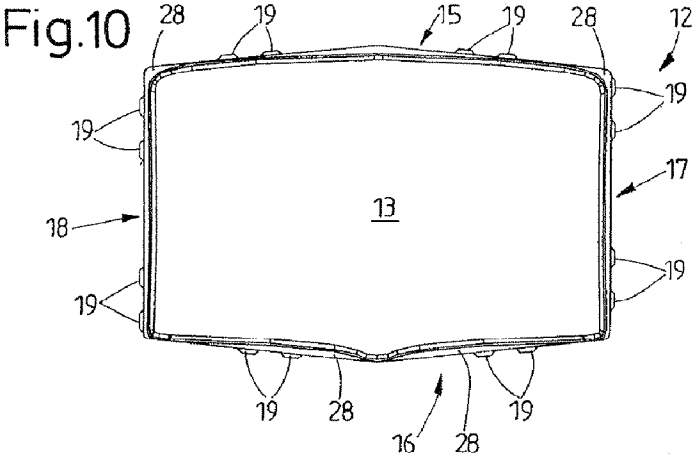
Figure 13:
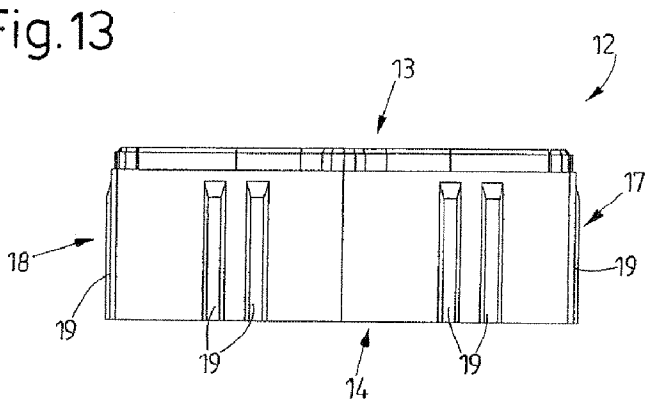
Figure 12:
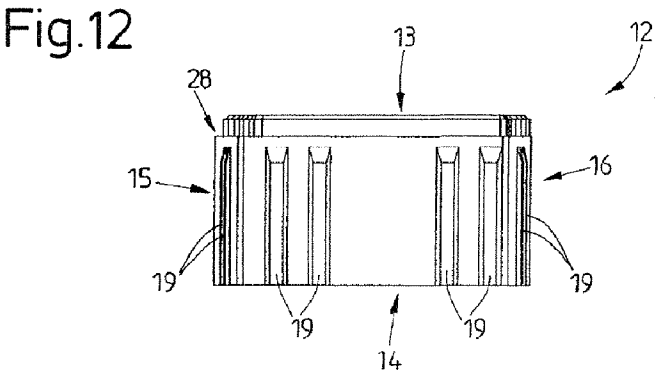
Figure 15:
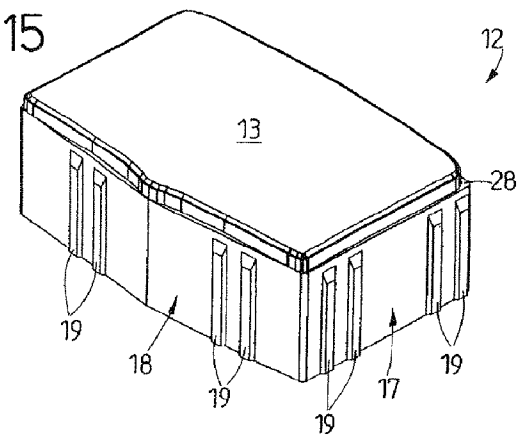
Figure 14:
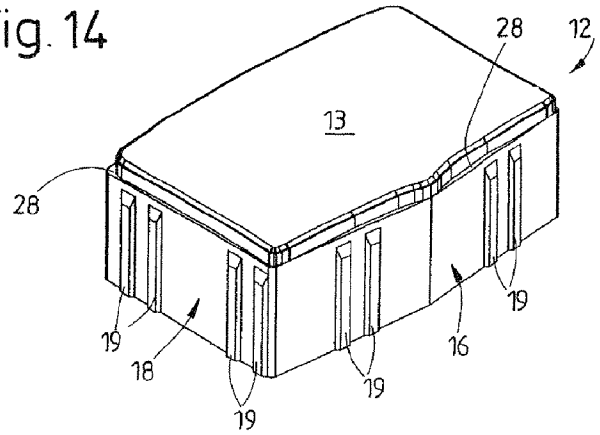
Figure 17:
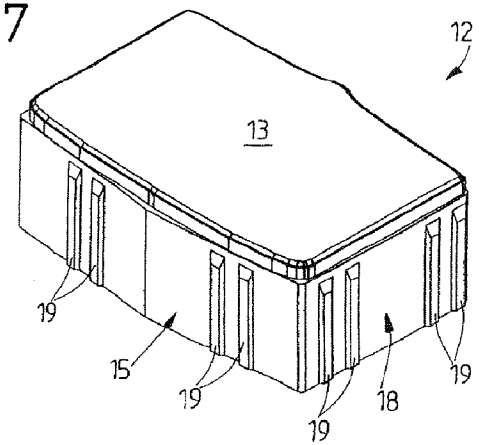
Figure 16:
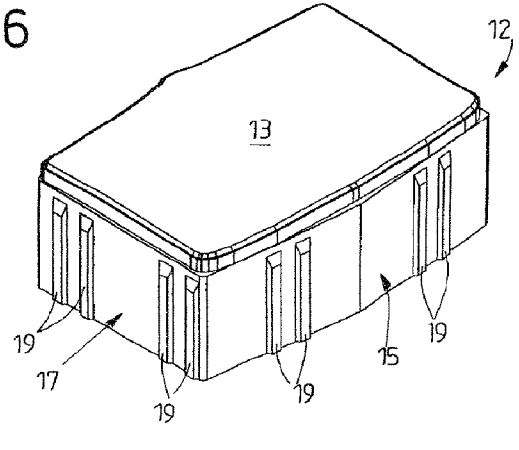

The following regions result with reference to FIG. 9:

1. A region 22 extends along the left-hand half of the longitudinal side face 15 as far as via the corner into the region of the transverse side face 18.
2. A region 22' results from mirroring the region 22 at the axis of symmetry 21.
3. A region 23 lies between the two regions 22 and 22'.
4. A region 24 adjoins the region 22 in the region of the transverse side faces 18.
5. A region 24' lies, mirrored via the axis of symmetry 21, on the opposite transverse side face 17.
6. A region 25 adjoins the region 24 and extends in the region of the corner between the transverse side face 18 and the longitudinal side face 16.
7. A region 25' results once again by mirroring of the region 25 at the axis of symmetry 21.
8. In a similar manner to the region 22 along the longitudinal side face 15, a region 26 extends along the longitudinal side face 16, however.
9. A region 26' corresponds to the region 26 mirrored at the axis of symmetry 21.
10. A region 27 is situated between the two regions 26 and 26' in the region of the axis of symmetry.

The course of the side edge 20 in the regions 22, 23, 24, 25, 26, 27 results as follows:

1. Regions 22 and 22': $f(x)=3*\ln(x)-19.5$
2. Region 23: constant radius r=56
3. Region 24: constant radius r=1.322
4. Regions 25 and 25': $f(x)=\ln(x)-137.5$
5. Regions 26 and 26': $f(x)=3*\ln(x)-19.5$
6. Region 27: constant radius r=28.3

The special feature of the molded brick 11 consists in the course of the side edge 20 therefore corresponding in the regions 22, 22', 25, 25' and 26, 26' to a mathematical function, namely on the basis of the logarithm. The regions which are curved in this way are connected to one another by constantly curved regions 23, 24, 24' and 27.

In this way, the result is a particularly harmonic course of the side edge 20. It goes without saying that the formula for the logarithmically curved regions can be varied according to the example:

$$f(x)=a*\ln(x)+b$$

Different values can be used for the variables a and b. Furthermore, the regions can be displaced by transformation.

A further special feature consists in the regions 26 and 26' of the side edge 20 being concavely arched, namely in relation to the center point of the upper side 13, whereas the remaining regions 22, 22', 23, 24, 24', 25, 25' and 27 are of convexly arched configuration.

The molded brick 12 according to FIGS. 10 to 17 differs from the molded brick 11 merely in that the regions 24 and 24' are of concavely arched configuration in the region of the transverse side faces 17, 18, and not of convexly arched configuration as in the first exemplary embodiment.

A common feature of both molded bricks 11, 12 is that the upright side faces 15, 16, 17, 18 are not of arched configuration, but rather are of rectilinear configuration. This results in a different course of the upright side faces in comparison with the side edge 20. This difference is compensated for by what are known as transition faces 28.

It can be seen from FIGS. 18 to 21 that the molded bricks 11 and 12 are laid together to form a common ground covering 10. Here, the molded bricks 11, 12 are laid in rows 29, the molded bricks 11, 12 being laid alternately within a row 29.

In addition, the rows 29 are arranged offset with respect to one another by half a brick length, in what is known as the half brick lattice. This manner of laying results in the following special features: the molded bricks 11, 12 lie so close to one another that, in the region of the transverse side faces 17, 18, a molded brick 11 with a convexly arched transverse side face 17 lies next to a molded brick 12 with a concavely arched transverse side face 18. A convex bulge 34, formed by the region 27, on the side edge 20 comes to lie between two transverse side faces 17, 18 of molded bricks 11, 12 of an adjacent row 29. The course of the joints between the molded bricks 11, 12 accordingly follows the course of the side edges 20.

Figures 18, 19, 20, 21:
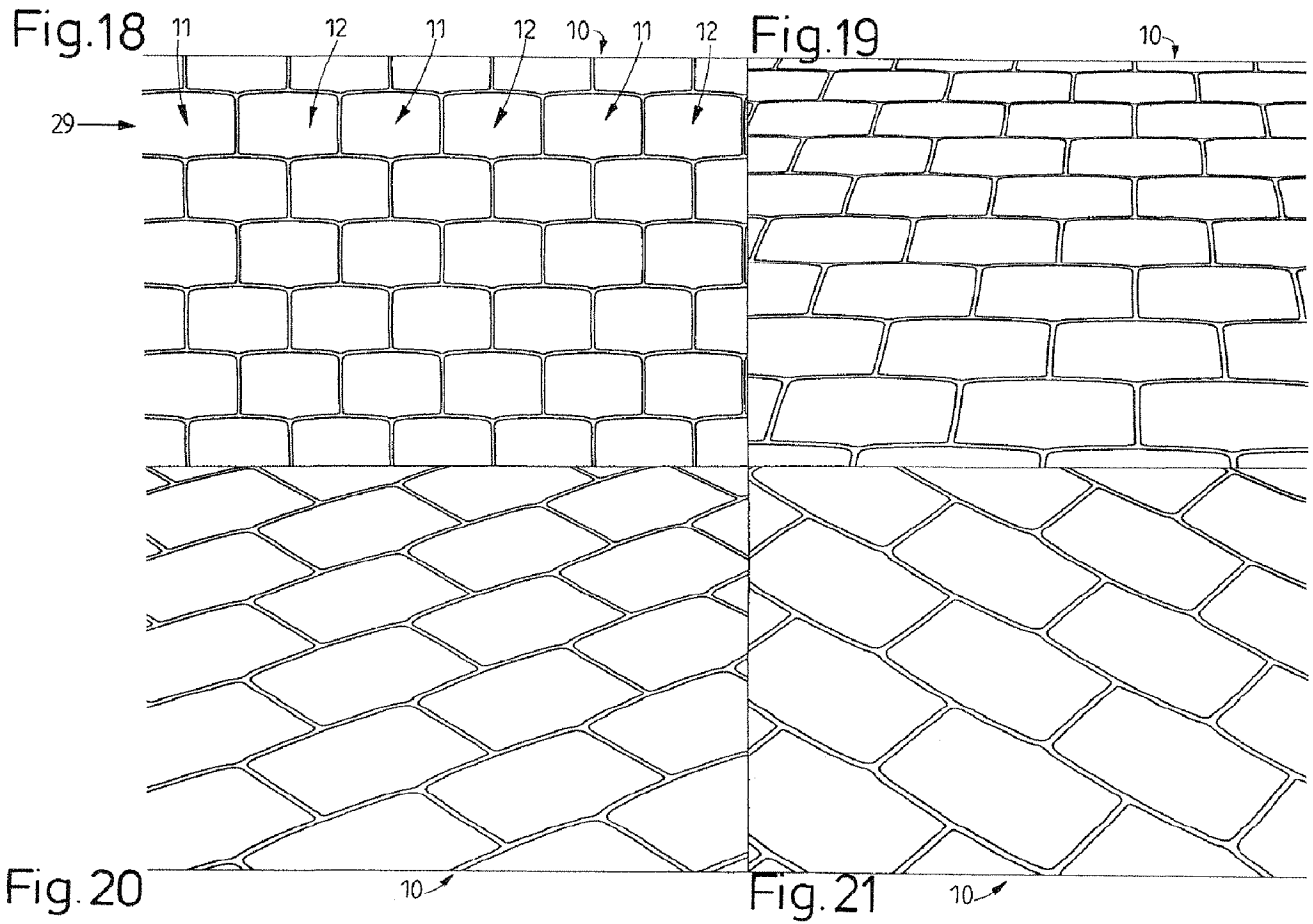
Figure 22:
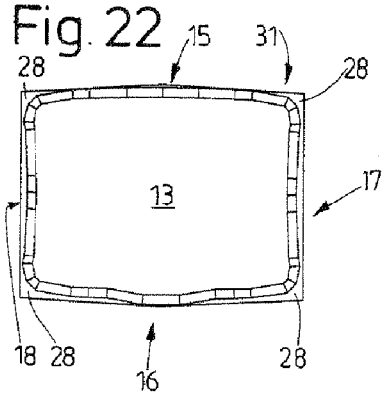
FIG. 22 shows a further molded brick according to the invention in a plan view.
Figure 23:
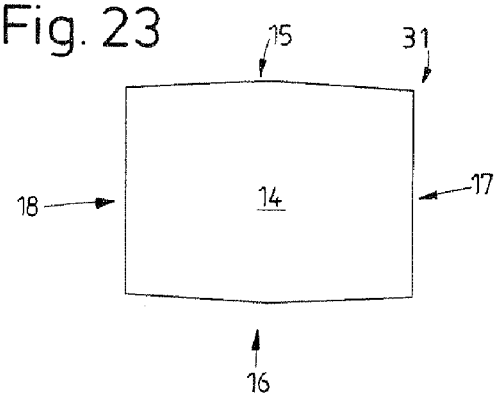
FIG. 23 to FIG. 27 show the molded brick according to FIG. 22 in further views and isometric representations.
Figure 24:
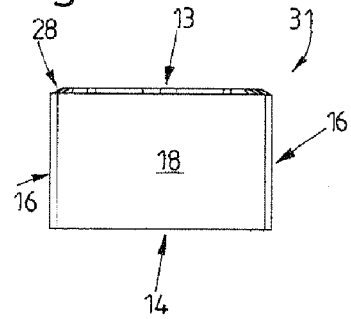
Figure 25:
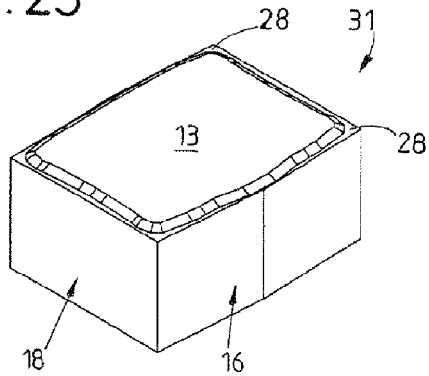
Figure 26:
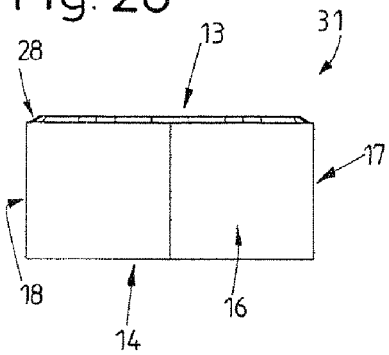
Figure 27:
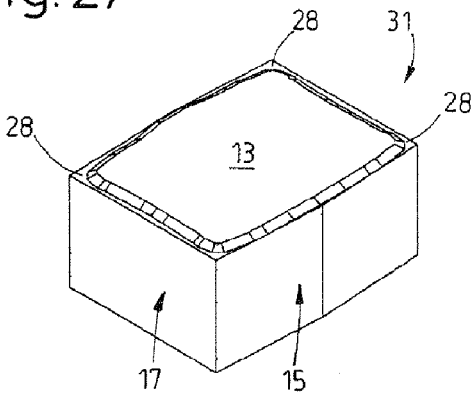
Figure 28:
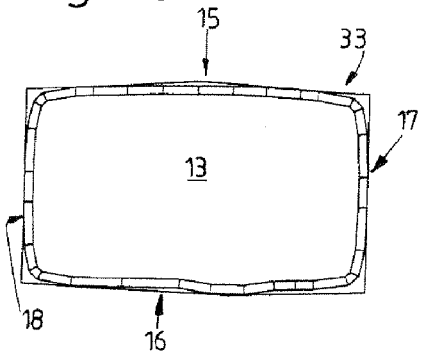
FIG. 28 to FIG. 33 show a further molded brick according to the invention in an analogous representation to FIGS. 22 to 27, FIG. 34 to FIG. 39 show a further molded brick according to the invention in an analogous representation to FIGS. 22 to 27, and FIG. 40 to FIG. 43 show a ground covering comprising molded bricks according to FIGS. 22 to 33 in a plan view and three-dimensional representations.
Figure 29:
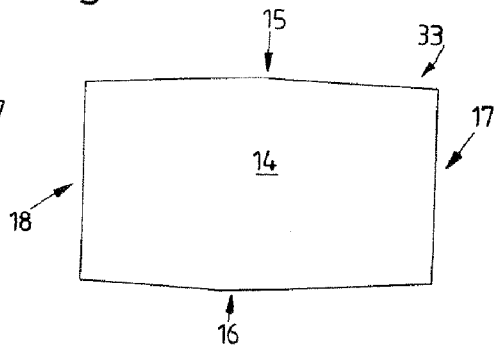
Figure 30:
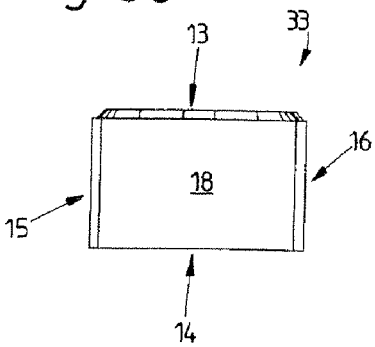
Figure 31:
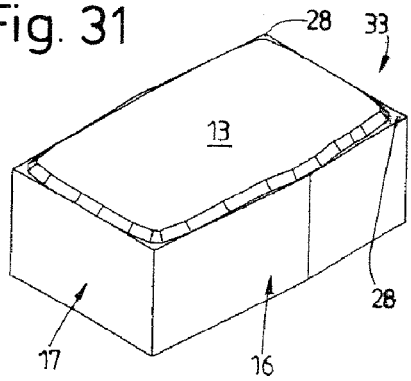
Figure 32:
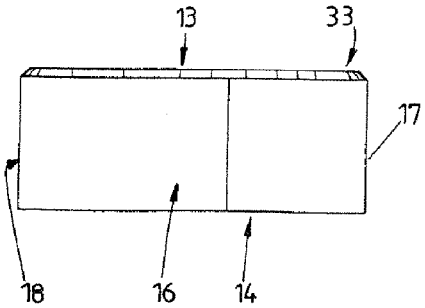
Figure 33:
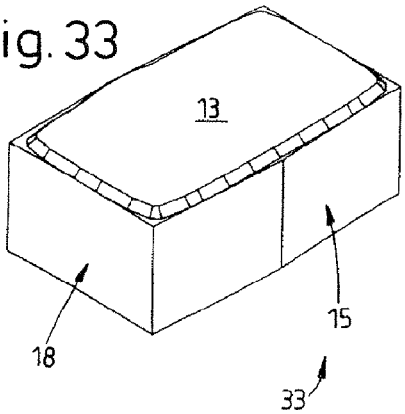
Figure 34:
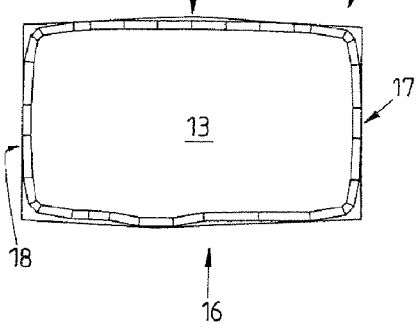
Figure 35:
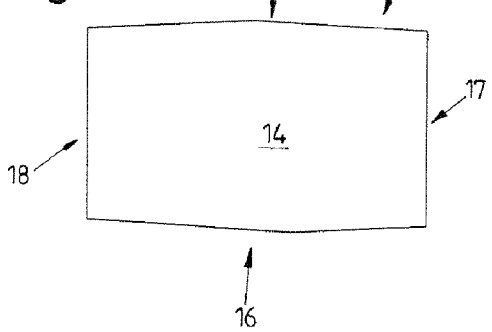
Figure 36:
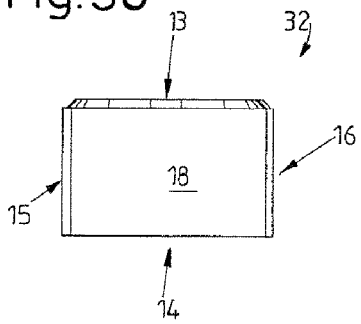
Figure 37:
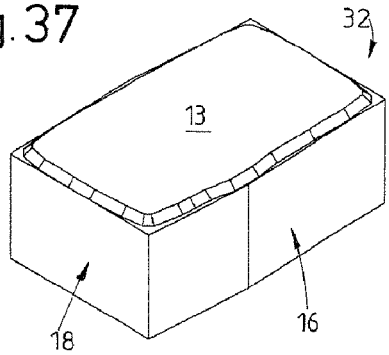
Figure 38:
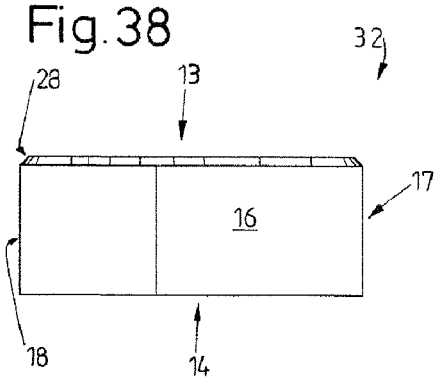
Figure 39:
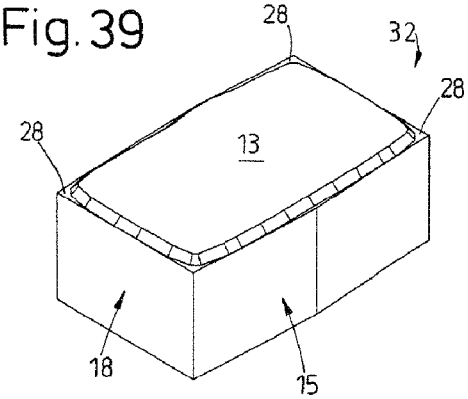
Figures 40, 41, 42, 43:
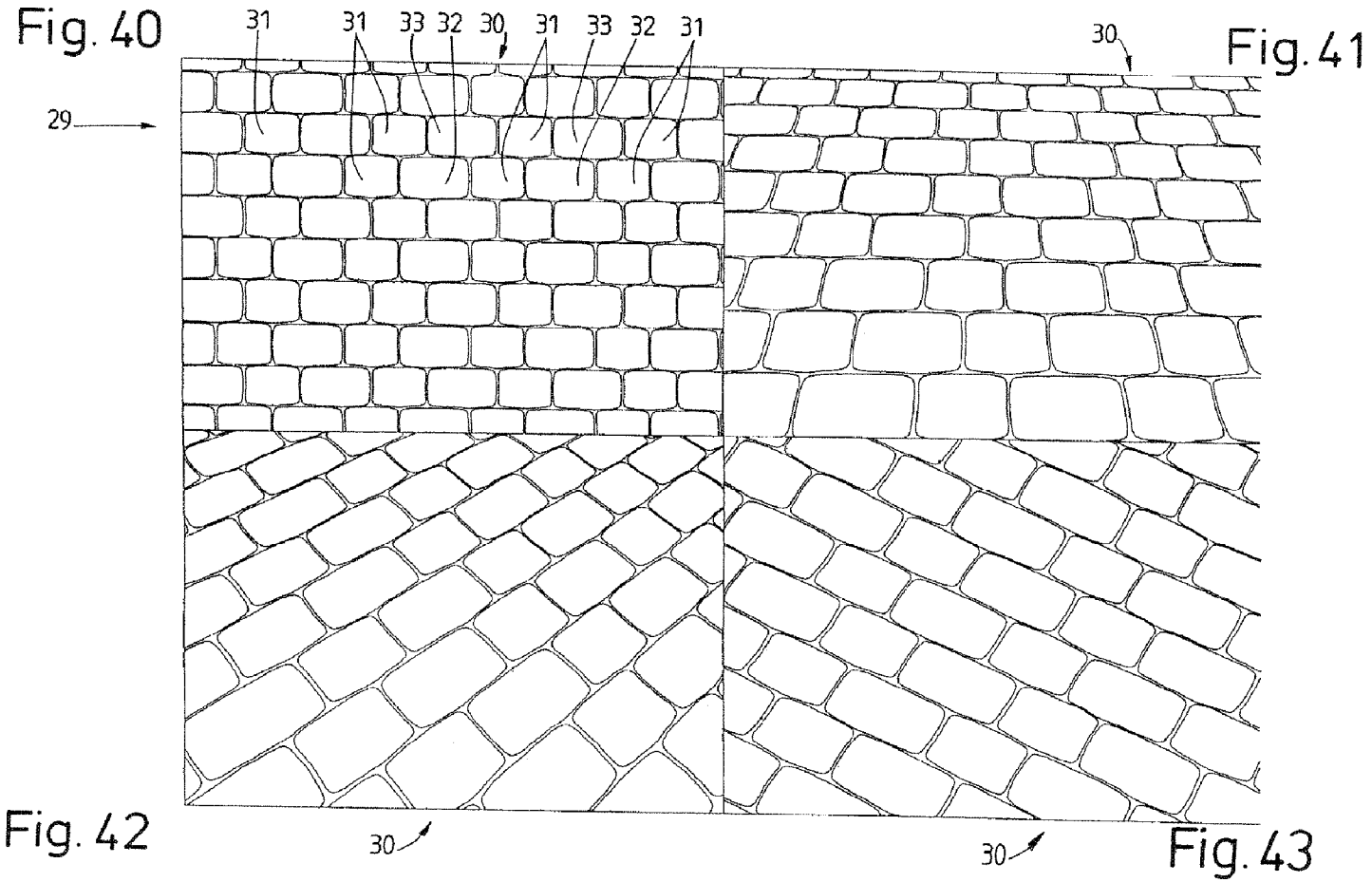

The ground covering 10 has an interesting optical effect as a result of this type of laying. The impression is namely produced that the molded bricks 11, 12 have an arched upper side 13, which is actually not the case. The representation according to FIG. 20 shows this optical effect clearly.

A further advantage results from the longitudinal side faces 15, 16 of angled away configuration. Within the ground covering 10, the two "halves" of the longitudinal side faces 15, 16 bear against correspondingly angled away regions of longitudinal side faces 15, 16 of adjacent molded bricks 11, 12. In this way, horizontal forces which act transversely with respect to the rows 29 are transmitted uniformly from a molded brick 11, 12 to two adjacent molded bricks 11, 12 of an adjacent row 29, without the otherwise usual tilting of the molded bricks 11, 12 and the associated edge pressures occurring.

FIGS. 22 to 43 show a second exemplary embodiment of the invention. In said figures, a ground covering 30 is produced from three different molded bricks 31, 32, 33. Molded brick 30 is shown in FIGS. 22 to 27. Molded brick 32 results from FIGS. 33 to 38, and molded brick 33 results from FIGS. 28 to 32.

The molded brick 31 shown in FIGS. 22 to 27 corresponds substantially to the molded brick 12 shown in FIGS. 10 to 17, but with shorter longitudinal side faces 15, 16. By way of example, a version is also shown without spacers on the upright side faces 15, 16, 17, 18.

The molded brick 32 shown in FIGS. 34 to 39 corresponds substantially to the molded brick 11 shown in FIGS. 1 to 9, but the angled away portion of the longitudinal side face 16 is not situated in the longitudinal center of the molded brick 32, but rather offset laterally with respect thereto. The molded brick 33 shown in FIGS. 28 to 32 is configured in accordance with the molded brick 32, but with a mirrored position of the angled away portion.

Within the laid ground covering 30, in each case two different types of molded bricks 31, 32 or 31, 33 are laid within a row 29, to be precise alternately as in the first exemplary embodiment. This therefore results in a corresponding laying pattern as in the first exemplary embodiment, but with a different optical impression.

It goes without saying that the ground coverings can also be configured with a greater number of different molded brick types.

LIST OF DESIGNATIONS

10 Ground covering
11 Molded brick
12 Molded brick
13 Upper side
14 Lower side
15 Longitudinal side face
16 Longitudinal side face
17 Transverse side face
18 Transverse side face
19 Spacer
20 Side edge
21 Axis of symmetry
22 Region
22' Region
23 Region
24 Region
24' Region
25 Region
25' Region
26 Region
26' Region
27 Region
28 Transition face
29 Row
30 Ground covering
31 Molded brick
32 Molded brick
33 Molded brick
34 Bulge

What is claimed is:

1. A molded brick for laying ground coverings (10, 30), the molded brick (11, 12, 31, 32, 33) comprising:
an upper side (13);
upright side faces (15, 16, 17, 18); and
a side edge (20),
wherein:
the upper side (13) is delimited in a transition to the upright side faces (15, 16, 17, 18) by the side edge (20) which frames the upper side (13), and
a course of the side edge (20) that circumferentially frames the upper side (13) of the molded brick (11, 12, 31, 32, 33) is of curved configuration at least along the side edge (20), the curved configuration corresponding to a mathematical function, wherein the mathematical function is $f(x)=a*\ln(x)+b$ whereby the course having the curved configuration has a harmonious course on the side edge that leads to an improved appearance of the molded brick.

2. The molded brick as claimed in claim 1, wherein the course of curved regions (22, 22', 25, 25', 26, 26') of the side edge (20) is different for different curved regions (22, 22', 25, 25', 26, 26') of the side edge (20) due to the use of different values for the variables a and b of the mathematical function for the different curved regions (22, 22', 25, 25', 26, 26') of the side edge (20).

3. The molded brick as claimed in claim 2, wherein the curved regions (22, 22', 25, 25', 26, 26') of the side edge (20) which correspond to the mathematical function are connected to circular extending regions (23, 24, 24', 27) of the side edge (20).

4. The molded brick as claimed in claim 1, wherein a course of the side edge (20) has concavely and convexly curved regions (22, 22', 23, 24, 24', 25, 25', 26, 26', 27).

5. The molded brick as claimed in claim 4, wherein the side edge (20) has a bulge (34) on a longitudinal side face (15, 16) of the molded brick (11, 12, 31, 32, 33), such that two concavely curved regions (26, 26') of the side edge (20) enclose a convexly curved region (27) of the side edge (20).

6. The molded brick as claimed in claim 4, wherein the upright side faces (15, 16, 17, 18) of the molded brick (11, 12, 31, 32, 33) are not of curved configuration, but extend substantially in a continuous plane and in an upright manner until shortly before the region of the upper side (13), the transition between the upright side faces (15, 16, 17, 18), which are planar, and the curved side edge (20) being compensated for by transition faces (28).

7. The molded brick as claimed in claim 1, wherein the side edge (20) is of concavely curved configuration in the region of short transverse side faces (17, 18) of the molded brick (12, 31).

8. The molded brick as claimed in claim 1, wherein the side edge (20) is of convexly curved configuration in the region of short transverse side faces (17, 18) of the molded brick (11, 32, 33).

9. A ground covering comprising molded bricks (11, 12, 31, 32, 33), the molded brick (11, 12, 31, 32, 33) comprising:
an upper side (13);
upright side faces (15, 16, 17, 18); and
a side edge (20),
wherein:
the upper side (13) is delimited in a transition to the upright side faces (15, 16, 17, 18) by the side edge (20) which frames the upper side (13), and
a course of the side edge (20) that circumferentially frames the upper side (13) of the molded brick (11, 12, 31, 32, 33) is of curved configuration at least along the side edge (20), the curved configuration corresponding to a mathematical function, wherein the mathematical function is $f(x)=a*\ln(x)+b$.

10. The ground covering as claimed in claim 9, wherein the molded bricks (11, 12, 31, 32, 33) are laid in longitudinal rows (29) and, within the rows (29), a) molded bricks (12, 31) having a side edge (20) of concavely curved configuration in the region of short transverse side faces (17, 18) of the molded brick (12, 31) and b) molded bricks (11, 32, 33) having a side edge (20) of convexly curved configuration in the region of the short transverse side faces (17, 18) of the molded brick (12, 31)

are arranged in each case alternately within the row (29), in such a way that the molded bricks (11, 32, 33) with the convexly configured side edge (20) in the region of the short transverse side faces (17, 18) are arranged next to the molded bricks (12, 31) with the concavely configured side edge (20) in the region of the short transverse side faces (17, 18).

11. The ground covering as claimed in claim 10, wherein adjacent rows (29) of the ground covering (10, 30) are arranged offset with respect to one another by half a brick length, in such a way that a bulge (34) of the molded brick (11, 12, 31, 32, 33) in one of the rows (29) is arranged in the region of a joint between the short transverse side faces (17, 18) arranged next to one another of the molded bricks (11, 12, 31, 32, 33) of an adjacent one of the row (29).

12. The ground covering as claimed in claim 9, wherein the ground covering (30) is formed from at least two different types of molded bricks (11, 12, 31, 32, 33), wherein each of the at least two different types of molded bricks has a different side edge (20) from each other by using different values for variables a and b of the mathematical function whereby the curved configuration of the side edge of each of the at least two different types of the molded bricks is different from each other.

13. The ground covering as claimed in claim 9, wherein the molded bricks (11, 12, 31, 32, 33) have longitudinal side faces (15, 16) which extend in an angled away manner, whereby those regions of the longitudinal side faces (15, 16) are angled obliquely towards a longitudinal axis of the molded bricks (11, 12, 31, 32, 33) extending parallel to corresponding regions of the longitudinal side faces (15, 16) of two adjacent molded bricks (11, 12, 31, 32, 33) of at least one adjacent row (29), in such a way that horizontal forces which occur transversely with respect to the row (29) are transmitted to the two molded bricks (11, 12, 31, 32, 33) of the adjacent row (29).

14. The molded brick as claimed in claim 1, wherein the course of the side edge (20) differs from a course of the upright side faces (15, 16, 17, 18) in that the course of the side edge (20) corresponds to the mathematical function while the upright side faces (15, 16, 17, 18) are generally flat or planar at least in regions.

15. The molded brick as claimed in claim 1, wherein the upright side faces (15, 16, 17, 18) are of rectilinear in spite of arced configuration with transition faces (28) compensating for a different course of the upright side faces (15, 16, 17, 18) in comparison with the side edge (20).

* * * * *